US006055009A

United States Patent [19]

Pickering et al.

[11] Patent Number: 6,055,009

[45] Date of Patent: Apr. 25, 2000

[54] RE-INKABLE BELT HEATING

[75] Inventors: James E. Pickering, Holcomb; Werner Fassler, Rochester; Charles D. DeBoer, Palmyra, all of N.Y.

[73] Assignee: Eastman Kodak Company, Rochester, N.Y.

[21] Appl. No.: 09/118,643

[22] Filed: Jul. 17, 1998

[51] Int. Cl.[7] ..... B41J 31/14; B41J 31/16

[52] U.S. Cl. ..... 347/171; 400/197; 400/198

[58] Field of Search ..... 347/171; 400/198, 400/200, 201, 202, 202.1, 202.2, 202.3, 202.4, 197

[56] References Cited

U.S. PATENT DOCUMENTS

| | | |
|---|---|---|
| 4,661,393 | 4/1987 | Uchiyama et al. . |
| 5,043,318 | 8/1991 | Kawakami et al. . |
| 5,118,657 | 6/1992 | Kawakami et al. . |
| 5,137,382 | 8/1992 | Miyajima . |
| 5,286,521 | 2/1994 | Matsuda et al. . |
| 5,334,574 | 8/1994 | Matsuda et al. . |
| 5,611,847 | 3/1997 | Guistina et al. . |
| 5,679,139 | 10/1997 | McInerney et al. . |
| 5,679,141 | 10/1997 | McInerney et al. . |
| 5,679,142 | 10/1997 | McInerney et al. . |
| 5,692,844 | 12/1997 | Harrison et al. . |
| 5,698,018 | 12/1997 | Bishop et al. . |

OTHER PUBLICATIONS

Vankataraman, The Chemistry of Synthetic Dyes; Academic Press, 1970: vols. 1–4.

The Colour Index Society of Dyers and Colouists, Yorkshire, England, vols. 1–8.

*Primary Examiner*—Huan Tran

*Attorney, Agent, or Firm*—Raymond L. Owens

[57] ABSTRACT

Apparatus for printing on a moveable receiver images corresponding to a digital image includes a re-inkable belt which includes a polymer support layer and an ink transfer layer having a plurality of colored patches provided over the polymer support layer wherein ink can be transferred to and from the ink transfer layer, the polymer support layer including heating elements disposed in the colored patches in the re-inkable belt which, when a potential is applied to them, heats their corresponding patch the ink transferable layer to facilitate ink transfer. The apparatus selectively applies potential to the heating elements in the re-inkable belt at an image transfer system and causes the moveable receiver to move into proximate contact with the re-inkable belt at an image transfer position. The apparatus further applies energy to selected heating elements to heat an appropriate patch of the re-inkable belt at the image transfer position to facilitate ink transfer and responsive to the digital image to imagewise transfer ink from the re-inkable belt to the receiver.

6 Claims, 3 Drawing Sheets

RE-INKABLE BELT HEATING

CROSS REFERENCE TO RELATED APPLICATIONS

Reference is made to commonly assigned U.S. patent application Ser. No. 09/058,016 filed Apr. 9, 1998 entitled "USING LASER LIGHT FOR THERMACOLOR PRINTING ON A MOVEABLE RECEIVER" to Fassler et al., the disclosure of which is incorporated herein by reference.

FIELD OF THE INVENTION

This invention relates to thermal printing, and, more particularly, to thermal printing with a re-inkable belt which is refreshed with colorant during the printing process.

BACKGROUND OF THE INVENTION

Color transfer thermal printers use a color donor member which may be a sheet, but usually is in the form of a web advanced from a supply roll to a take-up roll. The color donor member passes between a printhead and a dye receiver member. The thermal printhead comprises a linear array of resistive heat elements. In operation, the resistive heat elements of the printhead are selectively energized in accordance with data from a printhead control circuit. As a result, the image defined by the data from the printhead control circuit is placed on the receiver member.

A significant problem in this technology is that the color donor members used to make the thermal prints are generally intended for single (one time) use. Thus, although the member has at least three times the area of the final print and contains enough colorant to make a solid black image, only a small fraction of the color is ever used.

After printing an image, the color donor cannot be easily reused, although this has been the subject of several patents. The primary reason that inhibits reuse of the color donor is that the color transfer process is very sensitive to the concentration of the colorant in the donor layer. During the first printing operation, color is selectively removed from the layer thus altering its concentration. In subsequent printings, regions of the donor which had been previously imaged have a lower transfer efficiency than regions which were not imaged. This results in a ghost image appearing in subsequent prints.

The cost associated with having a single use donor ribbon is large because of the large area of ribbon required, as well as the large excess of colorant coated on the donor member. While this technology is able to produce high quality continuous tone prints, it is desired to provide an approach which has all of the good attributes of thermal color transfer imaging but without the limitations associated with single use donor members.

Work has been done by others to accomplish similar goals. See U.S. Pat. No. 5,286,521 which discusses a reusable wax transfer ink donor ribbon. This process is intended to provide a dye donor ribbon that may be used to print more than one page before the ribbon is completely consumed. U.S. Pat. No. 4,661,393 describes a reusable ink ribbon, again for wax transfer printing. U.S. Pat. No. 5,137,382 discloses a printer device capable of re-inking a thermal transfer ribbon. However, again the technology is wax transfer rather than dye transfer. In the device, solid wax is melted and transferred using a roller onto the reusable transfer ribbon.

U.S. Pat. No. 5,334,574 describes a reusable dye donor ribbon for thermal dye transfer printing. This reusable ribbon has multiple layers containing dye which limit the diffusion of dye out of the donor sheet. This enables the ribbon to be used to make multiple prints. In addition, the ribbon may be run at a slower speed than the dye receiver sheet, enabling additional utilization. U.S. Pat. No. 5,118,657 describes a multiple use thermal dye transfer ink ribbon. This ribbon has a high concentration dye layer on the bottom and low concentration dye layer on the top. The low concentration dye layer meters or controls dye transfer out of the ribbon. This enables the ribbon to be used multiple times. U.S. Pat. No. 5,043,318 is another example of a thermal dye transfer ribbon which can be used multiple times.

U.S. Pat. No. 5,692,844 describes an apparatus for thermal dye transfer printing wherein the spent donor is replenished with ink by saturation from a reservoir through a semi-permeable membrane. Replenishment by saturation is a slow process, since the spent donor must remain in contact with the re-inking supply for at least about 10 half-lives of the re-inking process.

SUMMARY OF THE INVENTION

An object of this invention is to facilitate the re-inking and printing of images from a inkable belt.

This object is achieved by apparatus for printing on a moveable receiver images corresponding to a digital image, comprising:

a) a re-inkable belt which includes a polymer support layer and an ink transfer layer having a plurality of colored patches provided over the polymer support layer wherein ink can be transferred to and from the ink transfer layer, the polymer support layer including heating elements disposed in the colored patches in the re-inkable belt which, when a potential is applied to them, heats their corresponding patch the ink transferable layer to facilitate ink transfer;

b) means for selectively applying potential to the heating elements in the re-inkable belt at an image transfer system;

c) means for causing the moveable receiver to move into proximate contact with the re-inkable belt at an image transfer position; and d) means for applying energy to selected heating elements to heat an appropriate patch of the re-inkable belt at the image transfer position to facilitate ink transfer and responsive to the digital image to imagewise transfer ink from the re-inkable belt to the receiver.

ADVANTAGES

An advantage of this invention is that the heated belt lessens the need for accurate control and speeds the process of the re-inking.

Another advantage of this invention is that the re-inkable belt donor is subject to less temperature differential and therefore will show less stress and mechanical wear.

Another advantage of this invention is that the apparatus can be made faster because the re-inkable belt needs less time to transfer the heat from the resistive print head.

A feature of this invention is that the images are inexpensive because there is no wasted belt material.

Another advantage of this advantage is that the color donor belt can be made of thick and durable material because heat diffusion in the longitudinal direction is diminished.

DETAILED DESCRIPTION OF THE INVENTION

Figure 1:
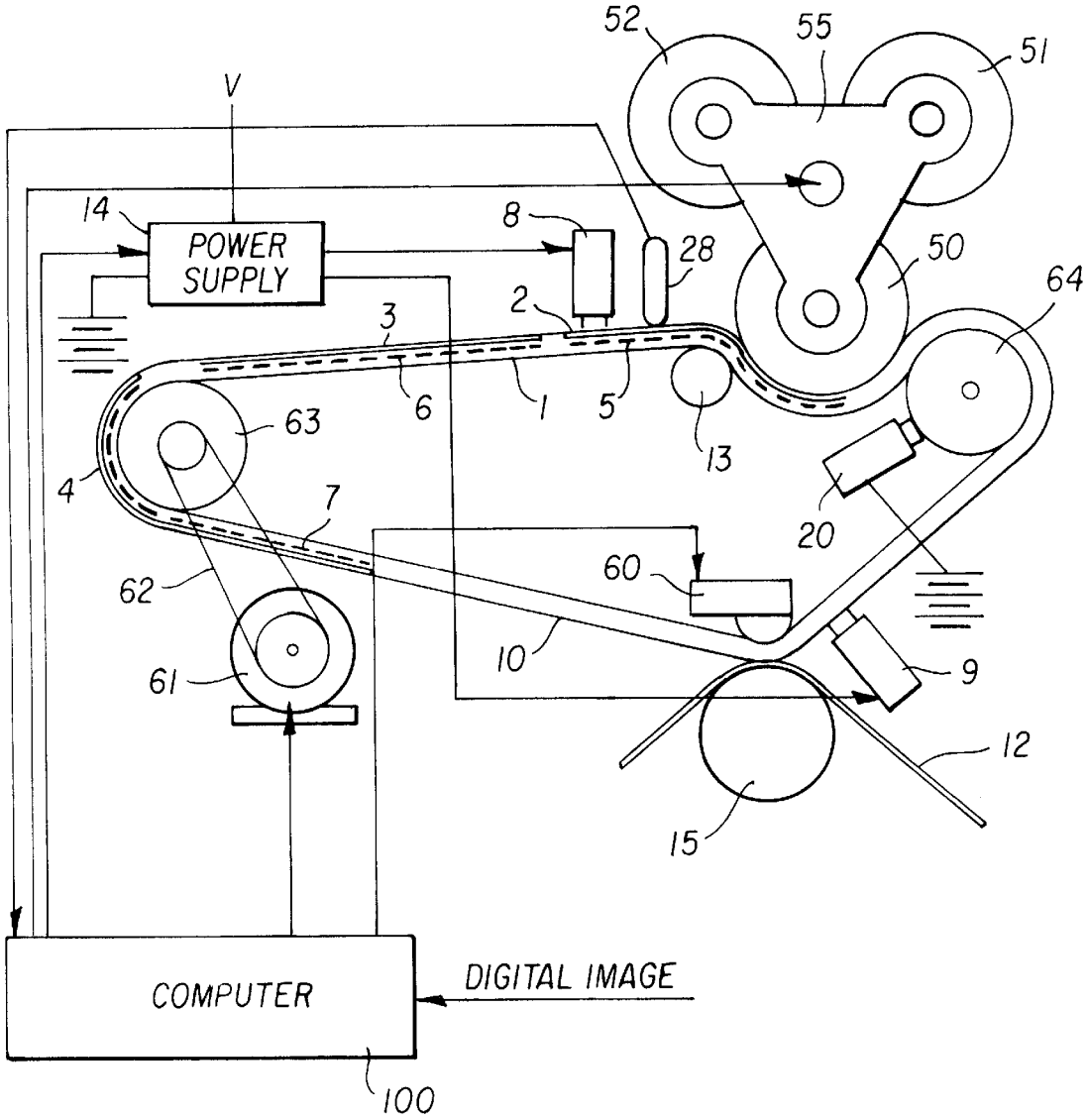
FIG. 1 shows a sectional view of apparatus in accordance with the present invention.

Turning to FIG. 1, a cross-sectional view of an apparatus for thermal printing with a re-inkable belt is shown. A re-inkable belt 1 is shown which acts as the donor for thermally printed images. "Re-inkable" means that ink transferred from the belt during printing of an image can be replaced and the belt used again. It will be understood by those skilled in the art that the term "ink" includes all manner of colorants and stains, including dispersions of pigments in common solvents, or solutions of dyes in such solvents. The inks must be heat transferable, that is, when a particular temperature is applied they will transfer from the re-inkable belt to a receiver. The re-inkable belt must be able to absorb ink at a replenishment station. The solvents used may be water, or may be organic solvents such as alcohols, ketones, esters, ethers, hydrocarbons, and mixtures of the same.

The re-inkable belt 1 includes a polymer support layer 20 and an ink transfer layer 10 having a plurality of colored patches provided over the polymer support layer 40. Ink can be transferred to and from the ink transfer layer 10. The polymer support layer 40 including heating elements 5, 6, and 7 disposed in the colored patches, respectively, in the re-inkable belt which, when a potential is applied to them, heats their corresponding patch the ink transferable layer to facilitate ink transfer.

Cyan, magenta, and yellow re-inking stations 50, 51, and 52, mounted on a turret 55 selectively supply the ink to re-ink the re-inkable belt 1, in patches of cyan 2, magenta 3, and yellow 4 ink. Re-inking is accomplished through the process of diffusion. The re-inking is done by engaging the cyan magenta and yellow re-inking stations 50, 51, and 52 with the re-inkable belt 1 by rotating the turret 55. The cyan, magenta and yellow re-inking stations 50, 51, and 52 must be in direct contact with a suitable pressure for a long enough time that ink saturation in the cyan, magenta and yellow ink patches 3, 4 and 5 can take place. Cyan, magenta and yellow patch heating elements 5, 6, and 7 are activated to help the diffusion process by heating the ink transfer layer 10 to increase the rate of dye diffusion from the cyan, magenta and yellow re-inking stations 50, 51, and 52 to the cyan, magenta, and yellow ink patches 2, 3, and 4. Two positive sliding electrical contacts 8 and 9 activate the cyan, magenta and yellow heaters 5, 6 and 7 at the position of re-inking or printing upon signal from a computer 100 which activates the power supply 14 which provides a voltage to the sliding electrical contacts 8 and 9. The computer 100 receives a digital image which can have three separate image planes cyan, magenta, and yellow. In response to the image planes of the digital image, the printing apparatus will cause images to be printed. The heater circuit is completed by a grounded sliding electrical contact 20 in contact with the transport roller 64. At an image transfer position, a thermal resistive head 60 heats the re-inkable belt 1 in an imagewise fashion, with each pixel where dye transfer is desired being imagewise heated. Transmission of the heat through the belt then causes the correct amount of colorant to transfer into the moveable receiver 12. To enhance the rate of the printing process the re-inkable belt 1 is heated with heaters 5, 6, and 7, electrically activated by the sliding electrical contact 9 which is positioned just before the image transfer position so that less energy is required from the printing head 60 for dye transfer. A platen roller 15 maintains the contact between the re-inkable belt 1, the print head 60, and the moveable receiver 12. The turret 55 has a separate re-inking station for each color. A preferred number of three colors, (a cyan re-inking station 50, a magenta re-inking station 51 and a yellow re-inking station 52 are shown to illustrate the three colors) are needed to achieve a "full color" images. The re-inkable belt 1 is driven by a motor 61, and an associated speed reduction belt 62.

Also shown are two transport rollers 63 and 64. The computer 100 provides the signals to operate the electric motor 61, the print head 60, the sliding electrical contacts 8 and 9, and the turret 55. A temperature sensor 28 is also shown which supplies signals to the computer 100 indicating the temperature of the dye transfer layer 10 so that higher or lower voltage can be supplied from the power supply 14 as needed.

Figure 2:
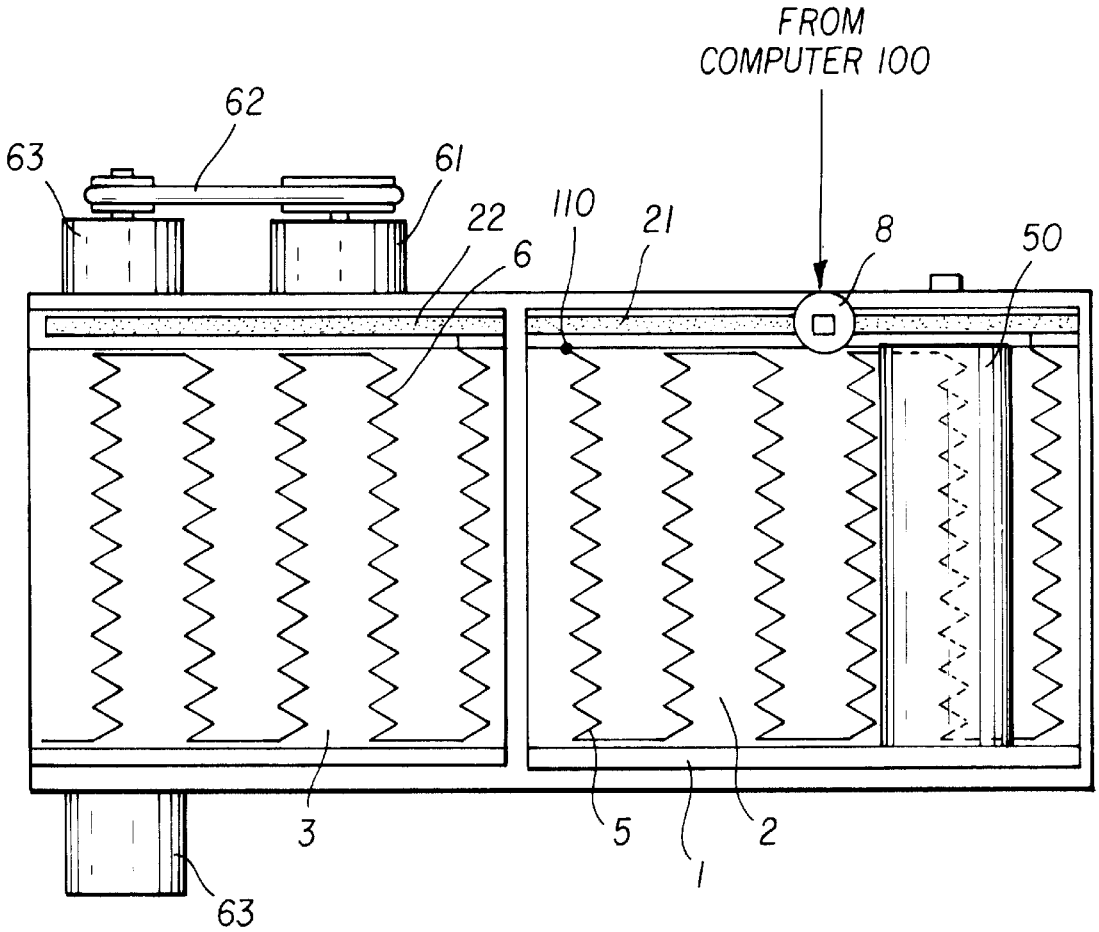
FIG. 2 shows a top view of the re-inkable belt of FIG. 1 and particularly illustrating the heating elements and contacts in the colored patches of such belt.

FIG. 2 shows a top view of the apparatus. Two color patches, cyan ink patch 2 and magenta ink patch 3 are shown. Cyan patch heater 5 and magenta patch heater 6 are shown as electrically resistive wires imbedded into the re-inkable belt 1. Other kinds of electrical heating schemes are equally possible, such as area wide resistive heating elements. Electrical contact strips 21 and 22 are also shown. In operation, the positive sliding electrical contact 8 delivers electrical power to the cyan patch heater 5 through the electrical contact strip 21 and the circuit is completed by the circuit ground 110 which is grounded through the transport roller 64 in FIG. 1. The heat generated by the cyan patch heater 5 causes the diffusion transfer of dye from the cyan re-inking station 50 to the dye receiving layer 10 on the re-inkable belt 1. The re-inkable belt, at a minimum, must include a polymer support layer 40 which has embedded therein heating elements. It may simplify manufacture of the re-inkable belt by using two different polymeric materials to contain and hold the embedded heating elements. On top of the polymer support layer 40 is coated an ink transfer layer 10. This particular re-inkable belt can be made as follows: a thin belt of thermoset polyamide is coated by high vacuum sputtering with an electrically resistive metal which is then patterned and etched by standard photolithographic techniques to provide the electrically resistive heating element. The heating element can then be overcoated with another layer of the same polyamide, or, alternatively, a solution of polyvinylsulfone (a heat resistant thermoplastic polymer) can be coated over the heating element and allowed to dry. The polyvinylsulfone layer may serve as the ink transfer layer 10, or another polymer may be coated on the polyvinylsulfone layer to serve as the ink transfer layer 10.

Figure 3:
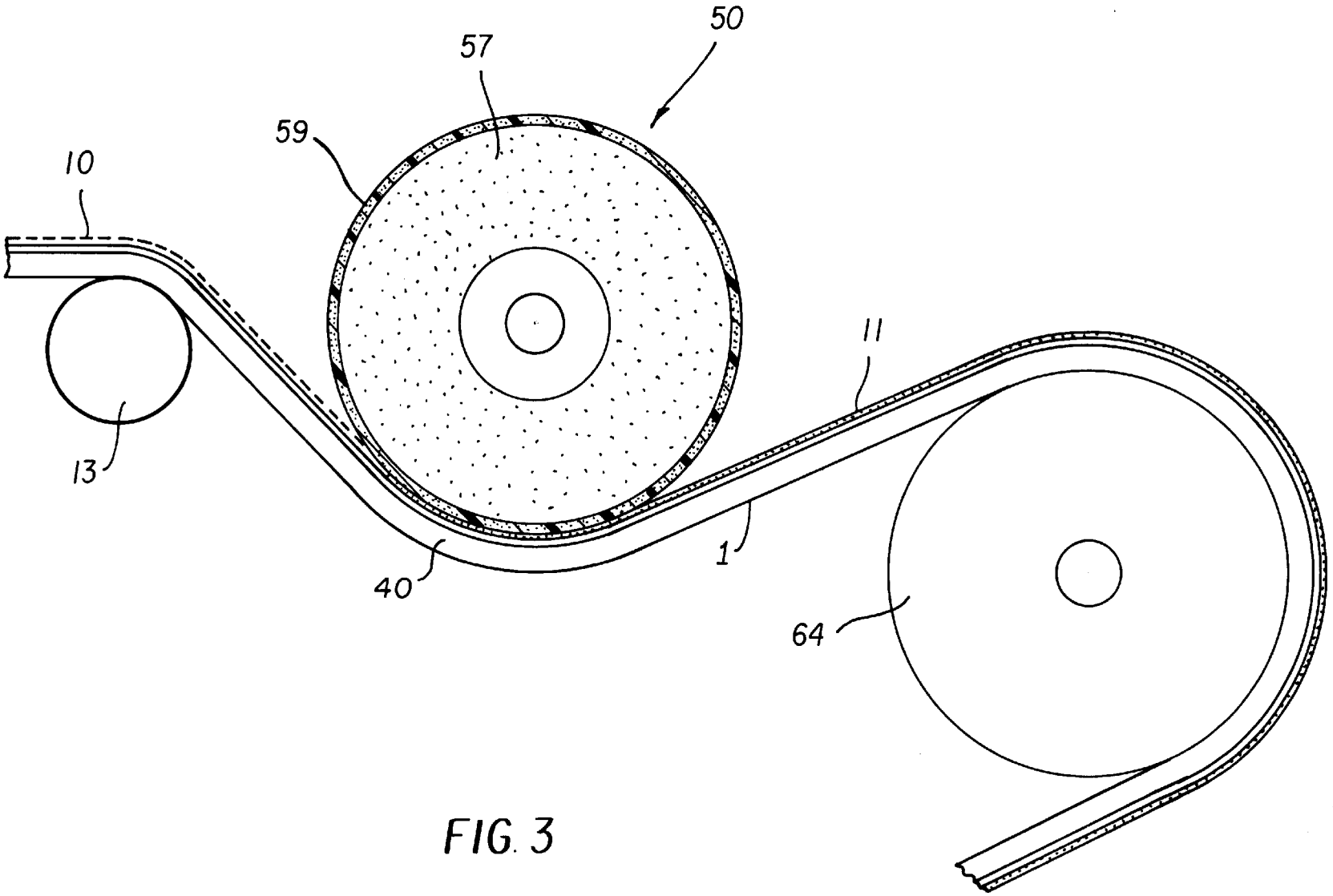
FIG. 3 shows an enlarged view of one of the re-inking stations of FIG. 1.

FIG. 3 shows an enlarged view of the re-inking station of FIG. 1. The cyan re-inking station 50 is shown in contact with the ink transfer layer 10 of the re-inkable belt 1, guided by a re-inking station roller 13 and the transport roller 64. The cyan re-inking station 50 has a fluid ink supply 57 contained by a semi-permeable membrane 59. After passing across the cyan re-inking station 50 the ink transfer layer 10 is shown as saturated ink transfer layer 11. The diffusion of ink through the semi-permeable membrane 59 and into the ink transfer layer 10 takes place at a rate which is temperature dependent. The higher the temperature, the faster the rate of diffusion. By heating the re-inkable belt 1, the rate of replenishment of ink at the replenishment position of the apparatus is increased, which allows a faster printing speed. Heat from the belt also warms the semi-permeable membrane and increases the rate of ink transfer through the semi-permeable membrane.

The inks used in this invention may be dispersions of pigments in common solvents, or solutions of dyes in such solvents. The liquid colorants that feed the re-inking stations 50, 51 and 52 of this invention are commonly called inks by those skilled in the art. Examples of such inks may be found in U.S. Pat. No. 5,611,847 by Gustina, Santilli and Bugner. Inks may also be found in the following commonly assigned U.S. Pat. Nos. 5,679,139; 5,679,141; 5,679,142; and 5,698,018, and in U.S. patent application Ser. No. 09/034,676 filed Mar. 4, 1998 Martin, the disclosure of which is incorporated herein by reference. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. Preferred examples of dyes used to make solution inks include those listed in Venkataraman, The Chemistry of Synthetic Dyes; Academic Press, 1970: Vols. 1–4 and The Colour Index Society of Dyers and Colourists, Yorkshire, England, Vols. 1–8. Examples of suitable dyes include cyanine dyes (e.g., streptocyanine, merocyanine, and carbocyanine dyes), squarylium dyes, oxonol dyes, anthraquinone dyes, diradical dicationic dyes (i.g., IR165), and polycyclic aromatic hydrocarbon dyes. Similarly, pigments can be included within the thermal mass transfer material to impart color and/or fluorescence. Examples are those known for use in the imaging arts including those listed in the Pigment Handbook; Lewis, P. A., Ed.; Wiley, New York, 1988, or available from commercial sources such as Hilton-Davis, Sun Chemical Co., Aldrich Chemical Co., and the Imperial Chemical Industries, Ltd.

The material chosen for the re-inkable belt 1 of this invention should be durable, flexible, and capable of uniform re-inking by the colorants. Polymeric materials forming the polymer support layer should be resistant to distortion by high temperature localized heating. An exemplary material is the thermoset polyamide resin Kapton, sold by the DuPont Corporation. Polydimethylsiloxane belts are also useful.

The invention has been described in detail, with particular reference to certain preferred embodiments thereof, but it should be understood that variations and modifications can be effected with the spirit and scope of the invention.

What is claimed is:

1. Apparatus for printing on a moveable receiver images corresponding to a digital image, comprising:

a) a re-inkable belt which includes a polymer support layer and an ink transfer layer having a plurality of colored patches provided over the polymer support layer wherein ink can be transferred to and from the ink transfer layer, the polymer support layer including heating elements disposed in the colored patches in the re-inkable belt which, when a potential is applied to them, heats their corresponding patch of the ink transfer layer to facilitate ink transfer;

b) a thermal print head responsive to the digital image for applying energy to the re-inkable belt to cause ink to imagewise transfer at an image transfer position to the receiver;

c) means for selectively applying potential to the heating elements in the re-inkable belt at an image transfer system to aid in the transfer of ink to the receiver; and d) means for applying) energy to selected heating elements to heat an appropriate patch of the re-inkable belt at a replenishment position to aid in re-inking the re-inkable belt.

2. The apparatus of claim 1 wherein the polymer support layer includes polymers selected from the group consisting of polyamide resin and polydimethylsiloxane.

3. The apparatus of claim 1 wherein there is a single heating element made of resistive metal in each patch.

4. The apparatus of claim 1 further including computer means responsive to the position of the belt for causing the selective energizing means of d) and e) to be actuated.

5. The apparatus of claim 1 wherein the thermal print head includes resistive heating elements disposed at the image transfer position for contacting the re-inkable belt for selectively heating such belt to a level to cause ink transfer.

6. The apparatus of claim 1 further including replenishment means for transferring different colored inks to different patched at the replenishment position.

* * * * *